US009776036B1

(12) United States Patent
Nieves

(10) Patent No.: US 9,776,036 B1
(45) Date of Patent: Oct. 3, 2017

(54) UPPER BODY EXERCISE DEVICE

(71) Applicant: Angelo Agosto Nieves, Fajardo, PR (US)

(72) Inventor: Angelo Agosto Nieves, Fajardo, PR (US)

( * ) Notice: Subject to any disclaimer, the term of this patent is extended or adjusted under 35 U.S.C. 154(b) by 0 days.

(21) Appl. No.: 15/201,976

(22) Filed: Jul. 5, 2016

(51) Int. Cl.
*A63B 21/00* (2006.01)
*A63B 21/062* (2006.01)
*A63B 23/035* (2006.01)

(52) U.S. Cl.
CPC ..... *A63B 21/154* (2013.01); *A63B 21/0626* (2015.10); *A63B 21/0628* (2015.10); *A63B 21/4035* (2015.10); *A63B 23/03508* (2013.01); *A63B 23/03516* (2013.01)

(58) Field of Classification Search
CPC ..... A63B 21/06–21/08; A63B 23/03558–23/03566
See application file for complete search history.

(56) References Cited

U.S. PATENT DOCUMENTS 3,524,644 A 8/1970 Kane
3,640,529 A 2/1972 Kane
4,441,706 A * 4/1984 Korzaniewski ..... A63B 21/06 482/102
4,750,739 A * 6/1988 Lange ..... A63B 21/0083 482/104
4,784,384 A * 11/1988 Deola ..... A63B 21/0628 482/138
5,328,428 A 7/1994 Huang
5,417,628 A 5/1995 Vanderbleek
5,492,518 A * 2/1996 Measom ..... A63B 21/00072 482/133
7,014,599 B2 3/2006 Ashley
2002/0077229 A1* 6/2002 McBride ..... A63B 21/04 482/130
2011/0224051 A1* 9/2011 Larish ..... A63B 21/012 482/93
2013/0116097 A1 5/2013 Tseng

FOREIGN PATENT DOCUMENTS

CN 201394305 2/2010

* cited by examiner

*Primary Examiner* — Sundhara Ganesan
*Assistant Examiner* — Jennifer M Deichl

(57) ABSTRACT

The upper body exercise device is a resistance based training device that is adapted for use by a person. Specifically, the upper body exercise device uses the weight of the exerciser to generate a counterforce that provides resistance to specific upper body exercises. The upper body exercise device comprises a frame, a first resistance system, a second resistance system, and a third resistance system.

6 Claims, 6 Drawing Sheets

190
162
164
189
221
181
141
161
143
131
217
147
110
140
149
130
145
215
121
151
120

UPPER BODY EXERCISE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of apparatus for physical training, more specifically, an exercise apparatus for the strengthening of muscles and joints by working against a counterforce.

SUMMARY OF INVENTION

The upper body exercise device is a resistance based training device that is adapted for use by a person. Specifically, the upper body exercise device uses the weight of the exerciser to generate a counterforce that provides resistance to specific upper body exercises.

These together with additional objects, features and advantages of the upper body exercise device will be readily apparent to those of ordinary skill in the art upon reading the following detailed description of the presently preferred, but nonetheless illustrative, embodiments when taken in conjunction with the accompanying drawings.

In this respect, before explaining the current embodiments of the upper body exercise device in detail, it is to be understood that the upper body exercise device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the upper body exercise device.

It is therefore important that the claims be regarded as including such equivalent construction insofar as they do not depart from the spirit and scope of the upper body exercise device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
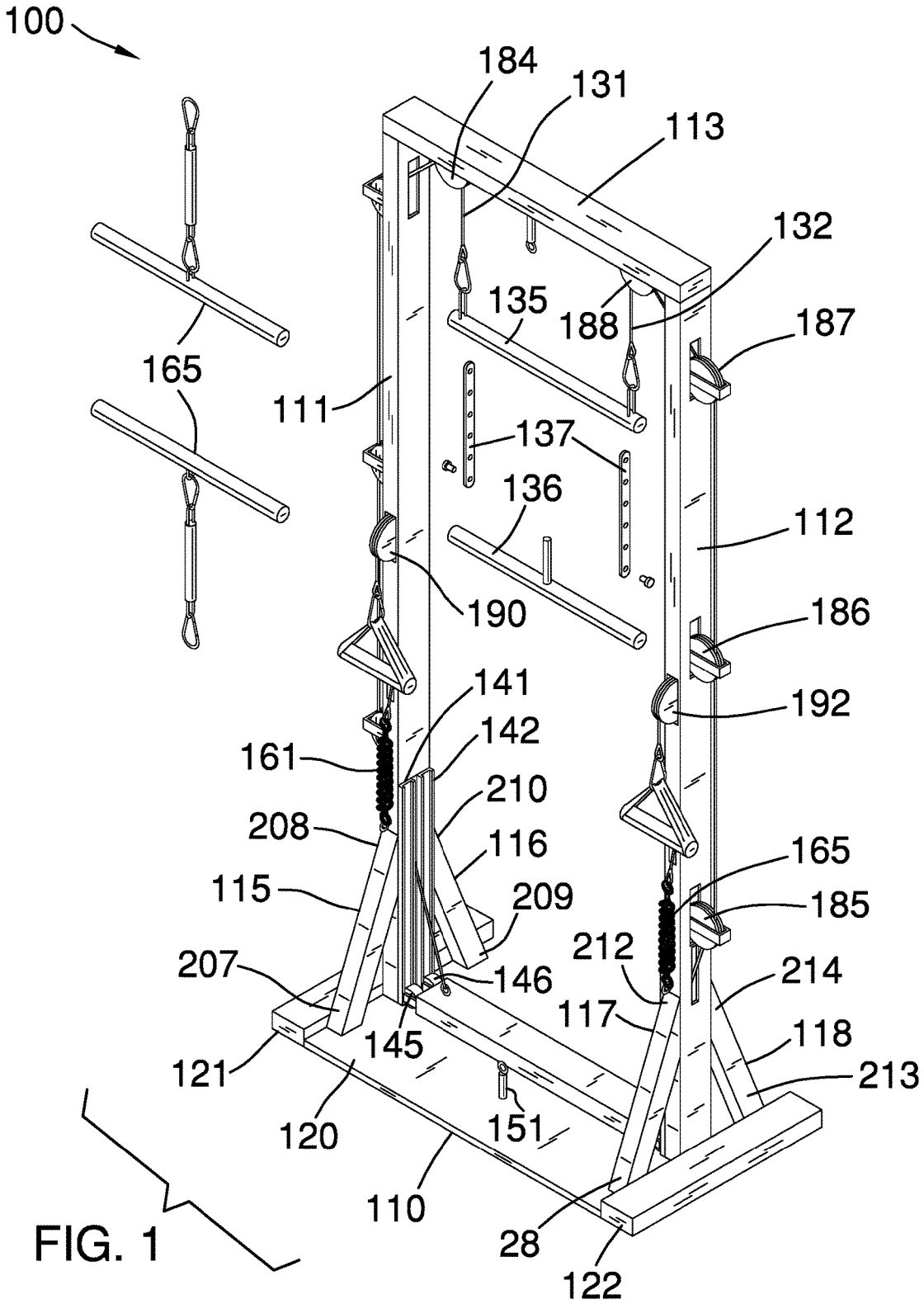
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The upper body exercise device 100 (hereinafter invention) comprises a frame 101, a first resistance system 102, a second resistance system 103, and a third resistance system 104. The invention 100 is a resistance based training device that is adapted for use by a person. Specifically, the invention 100 uses the weight of the exerciser to generate a counterforce that provides resistance to specific upper body exercises.

The frame 101 is the basis structure upon which the first resistance system 102, the second resistance system 102, and the third resistance system 103 is attached. The frame 101 comprises a platform 110, a first side brace 111, a second side brace 112, a top brace 113, a first cross strut 115, a second cross strut 116, a third cross strut 117, and a fourth cross strut 118. The platform 110 further comprises a steel plate 120, a first tip guard 121, and a second tip guard 122. The first side brace 111 is further defined with a first end 201 and a second end 202. The second side brace 112 is further defined with a third end 203 and a fourth end 204. The top brace 113 is further defined with a fifth end 205 and a sixth end 206. The first cross strut 115 is further defined with a beveled seventh end 207 and a beveled eighth end 208. The second cross strut 116 is further defined with a beveled ninth end 209 and a beveled tenth end 210. The third cross strut 117 is further defined with a beveled eleventh end 211 and a beveled twelfth end 212. The fourth cross strut 118 is further defined with a beveled thirteenth end 213 and a beveled fourteenth end 214.

The platform 110 is the bottom structure of the invention 100. The platform 110 rests directly on the supporting surface 171 upon which the invention 100 is placed. The steel plate 120 is a metal plate that is positioned at the very bottom of the invention 100. As shown most clearly in FIG. 1, the first tip guard 121 and the second tip guard 122 are steel tubes that are attached to the steel plate 120 such that the major length of the first tip guard 121 and the second tip guard 122 run parallel to the supporting surface 171. The first tip guard 121 and the second tip guard 122 are further positioned such that the first tip guard 122 and the second tip guard 123 are perpendicular to a line that connects the centers of the first side brace 111 and the second side brace 112. The first tip guard 121 and the second tip guard 122 are levers that are designed to prevent the invention 100 from tipping over.

Figure 2:
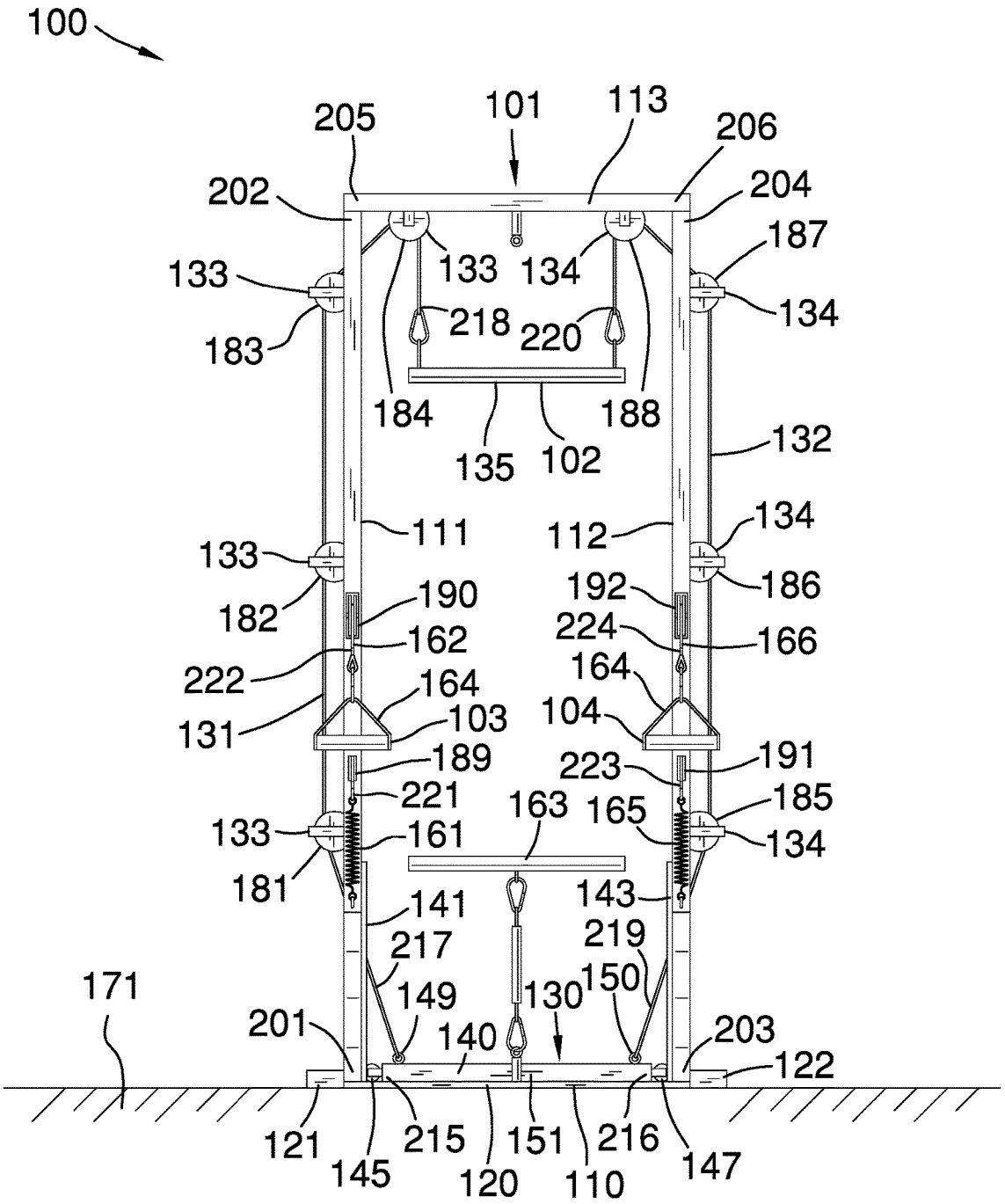
FIG. 2 is a front view of an embodiment of the disclosure.
Figure 3:
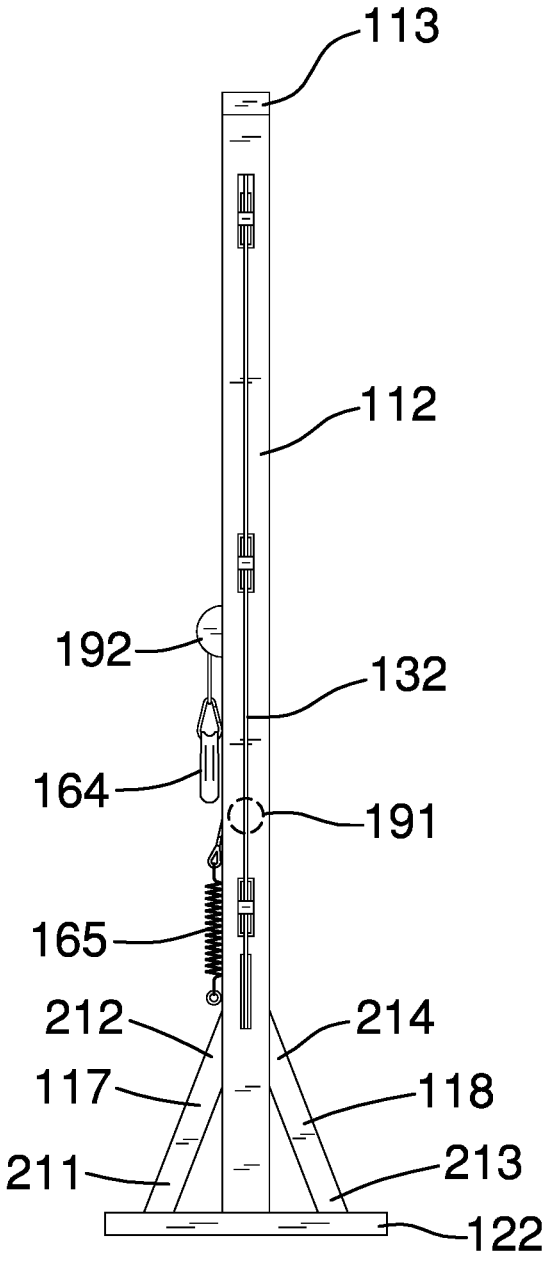
FIG. 3 is a side view of an embodiment of the disclosure.
Figure 4:
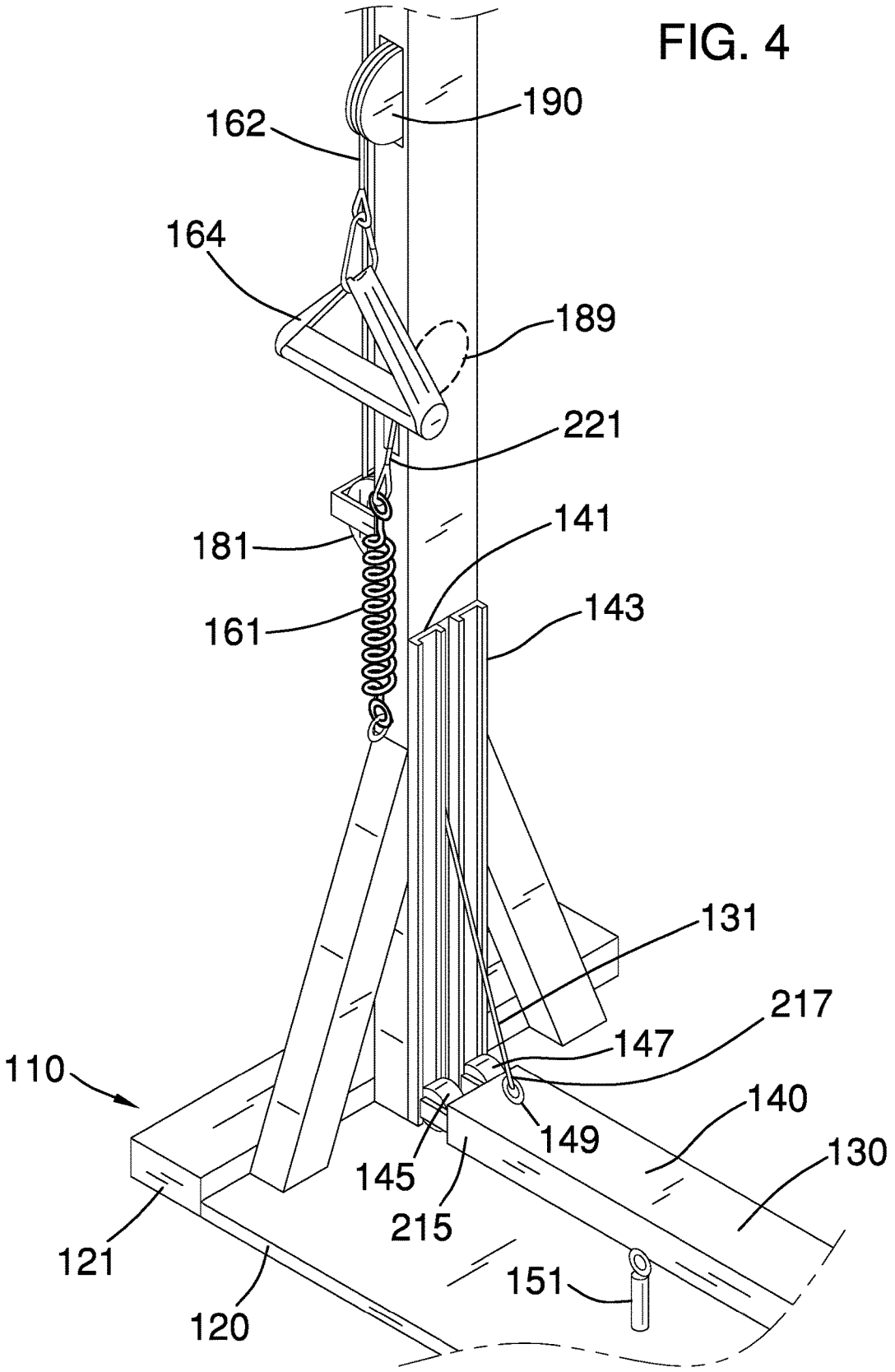
FIG. 4 is a detail view of an embodiment of the disclosure.
Figure 5:
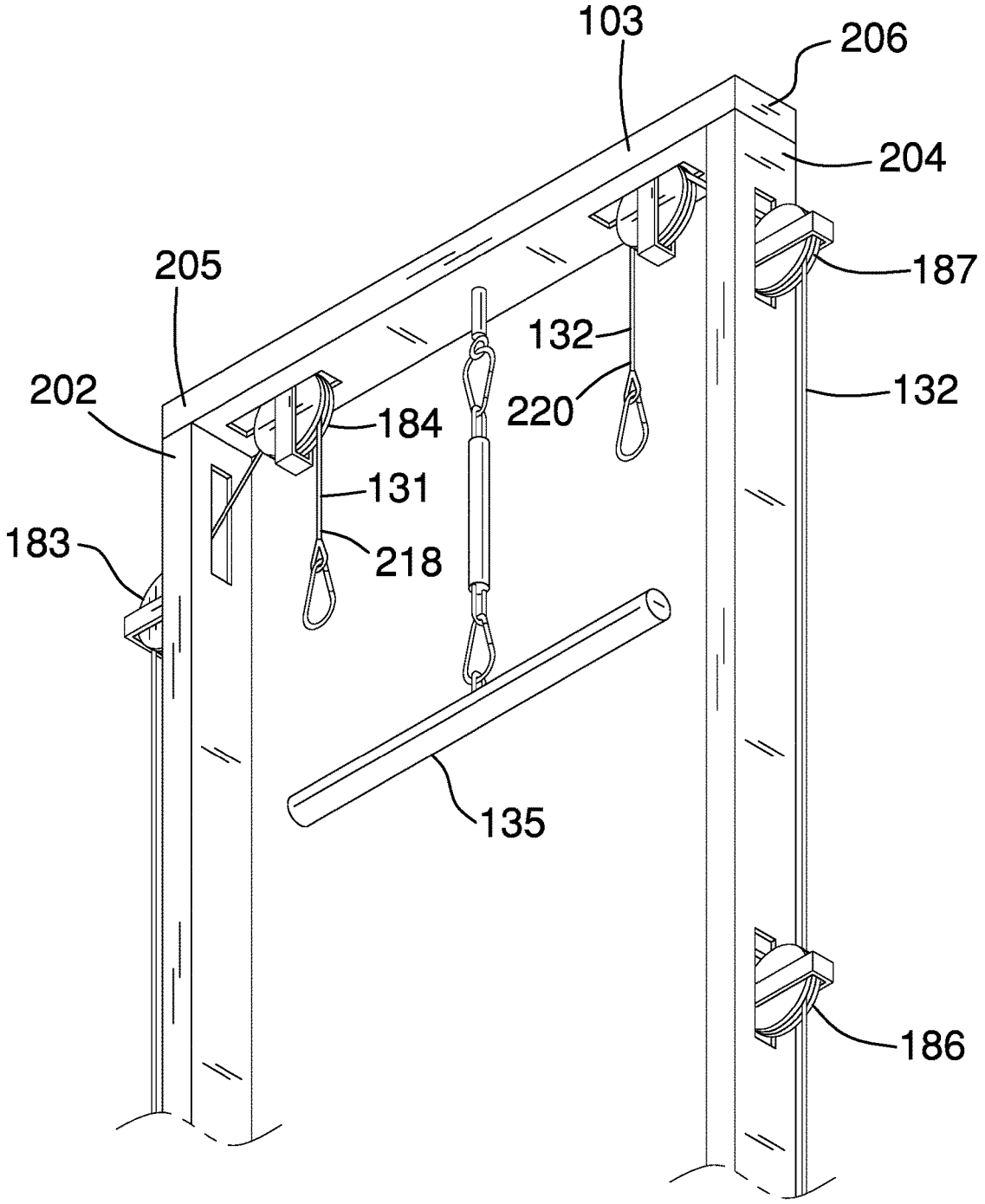
FIG. 5 is a detail view of an embodiment of the disclosure.
Figure 6:
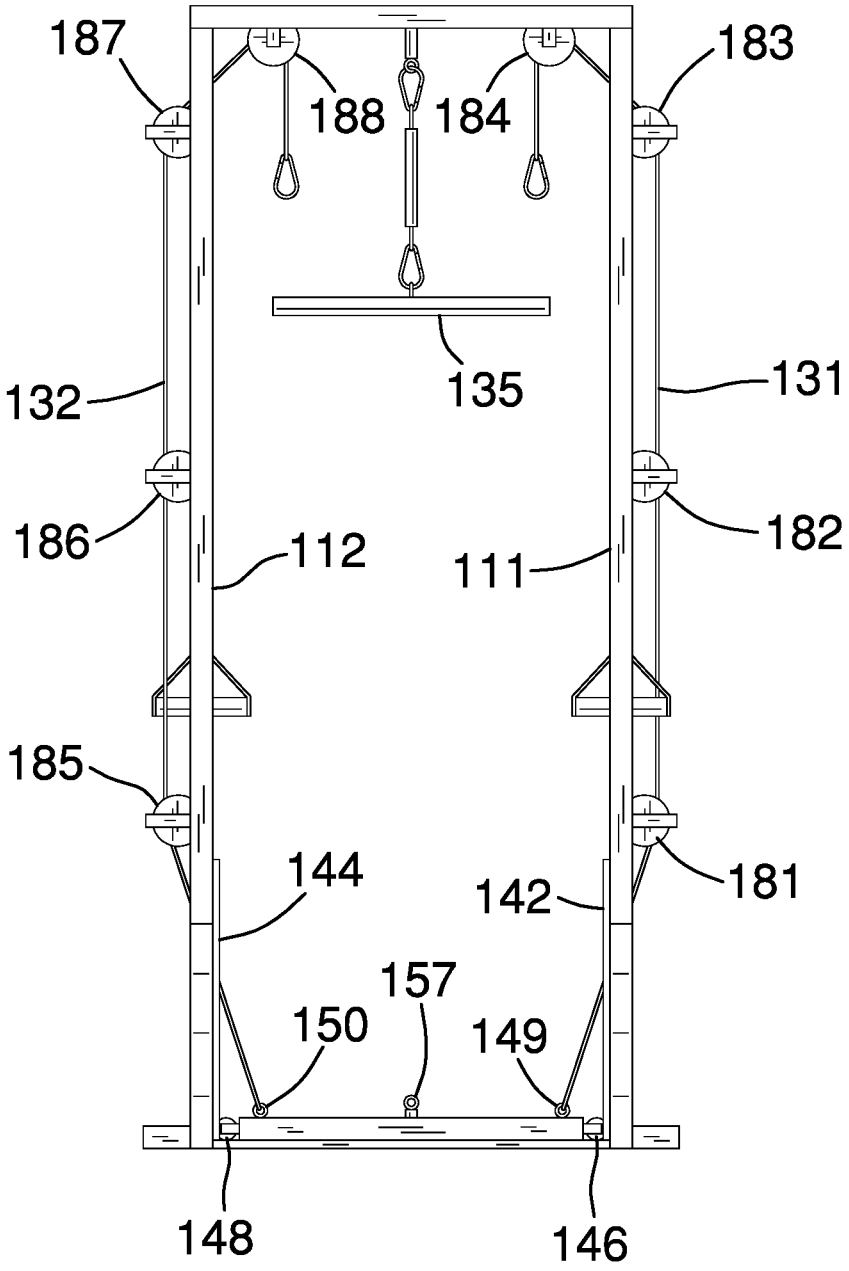
FIG. 6 is a rear view of an embodiment of the disclosure.

As shown most clearly in FIGS. 1 and 2, the assembly of the frame 101 is completed as described in this paragraph. The first end 201 of the first side brace 111 is attached to the steel plate 120 and the first tip guard 121 such that the first side brace 111 projects perpendicularly away from the steel plate 120. The third end 203 of the second side brace 112 is attached to the steel plate 120 and the second tip guard 122 such that the second side brace 112 projects perpendicularly away from the steel plate 120. The seventh end 207 of the first cross strut 115 is attached to the steel plate 120 and the first tip guard 121. The eighth end 208 of the first cross strut 115 is attached to the first side brace 111. The ninth end 209 of the second cross strut 116 is attached to the steel plate 120 and the first tip guard 121. The tenth end 210 of the second cross strut 116 is attached to the first side brace 111. The eleventh end 211 of the third cross strut 117 is attached to the steel plate 120 and the second tip guard 122. The twelfth end 212 of the third cross strut 117 is attached to the second side brace 112. The thirteenth end 213 of the fourth cross strut 118 is attached to the steel plate 120 and the second tip guard 122. The fourteenth end 214 of the fourth cross strut 118 is attached to the second side brace 112. The second end 202 of the first side brace 111 is attached to the fifth end 205 of the top brace 113. The fourth end 204 of the second side brace 112 is attached to the sixth end 206 of the top brace 113.

The first resistance system 102 comprises a weight stand 130, a first cable 131, a second cable 132, a first plurality of pulleys 133, a second plurality of pulleys 134, a first weight bar 135, a second weight bar 136 and a height extension 137. The first cable 131 is further defined with a seventeenth end 217 and an eighteenth end 218. The second cable 132 is further defined with a nineteenth end 219 and a twentieth end 220.

The theory of operation of the first resistance system is described in this paragraph. The weight stand 130 is attached to the first weight bar 135 using the first plurality of pulleys 133, the second plurality of pulleys 134, the first cable 131, and the second cable 132. These components are assembled such that when exerciser stands or kneels on the weight stand 130 and pulls down on the first weight bar 135, exerciser actually lifts themselves. In this manner, the weight of the exerciser actually provides the resistance for the exercise.

As shown most clearly in FIG. 1, the second weight bar 136 and the height extension 137 can be added to the first weight bar 135 for the purpose of adjusting the height of the first weight bar 135. The purpose for doing this is to allow for the adjustment of the invention 100 to accommodate: 1) exercisers of different heights; and, 2) to accommodate exercising while kneeling on the weight stand 130.

The weight stand 130 further comprises a stand plate 140, a first runner 141, a second runner 142, a third runner 143, a fourth runner 144, a first track wheel 145, a second track wheel 146, a third track wheel 147, and a fourth track wheel 148. The stand plate 140 further comprises a first eyebolt 149, a second eyebolt 150, and an attachment 151. The stand plate 140 is further defined with a fifteenth end 215 and a sixteenth end 216. The stand plate 140 is a steel tubing upon which the exerciser will stand or kneel.

Each runner is a track in which a track wheel will roll. The purpose of each runner is to provide a smooth and controlled glide path as the weight stand 130 is raised and lowered by the exerciser. The first runner 141 is attached to the first side brace 111 such that a track wheel running in the first runner 141 will roll in a direction perpendicular to the steel plate 120. The second runner 142 is attached to the first side brace 111 such that a track wheel running in the second runner 142 will roll in a direction perpendicular to the steel plate 120. The third runner 143 is attached to the second side brace 112 such that a track wheel running in the third runner 143 will roll in a direction perpendicular to the steel plate 120. The fourth runner 144 is attached to the second side brace 112 such that a track wheel running in the fourth runner 144 will roll in a direction perpendicular to the steel plate 120.

The first track wheel 145 and the second track wheel 146 are attached to the fifteenth end 215 of the stand plate 140. The first track wheel 145 and the second track wheel 146 are positioned such that the first track wheel 145 can be inserted into the first runner 141 and the second track wheel 146 can be inserted in the second runner 142. The third track wheel 147 and the fourth track wheel 148 are attached to the sixteenth end 216 of the stand plate 140. The third track wheel 147 and the fourth track wheel 148 are positioned such that the third track wheel 147 can be inserted into the third runner 143 and the fourth track wheel 148 can be inserted in the fourth runner 144. The first eyebolt 149 is installed in the surface of the stand plate 140 that is distal from the steel plate 120. The second eyebolt 150 is installed in the surface of the stand plate 140 that is distal from the steel plate 120.

The attachment 151 is a commercially available device that is attached to the stand plate 140. The attachment 151 allows the exerciser to attach a push pull bar 163 to the weight stand 130 allowing the weight of the weight stand 130 to provide the resistance for curl type exercises. The seventeenth end 217 of the first cable 131 is attached to the first eyebolt 149. The nineteenth end 219 of the second cable 132 is attached to the second eyebolt 150.

The first plurality of pulleys 133 comprises a first pulley 181, a second pulley 182, a third pulley 183, and a fourth pulley 184. The first pulley 181, the second pulley 182, and the third pulley 183 are mounted on the first side brace 111. The fourth pulley 184 is mounted on the top brace 113. The second plurality of pulleys 134 comprises a fifth pulley 185, a sixth pulley 186, a seventh pulley 187, and an eighth pulley 188. The fifth pulley 185, the sixth pulley 186 and the seventh pulley 187 are mounted on the second side brace 112. The eighth pulley 188 is mounted on the top brace 113. As shown most clearly in FIG. 2, the eighteenth end 218 of the first cable 131 is threaded through the first pulley 181, the second pulley 182, the third pulley 183, and the fourth pulley 184 and is attached to the first weight bar 135. The twentieth end 220 of the second cable 132 is threaded through the fifth pulley 185, the sixth pulley 186, the seventh pulley 187, and the eighth pulley 188 and is attached to the first weight bar 135.

The second resistance system 103 and the third resistance system 104 are mounted on the first side brace 111 and the second side brace 112 respectively. The second resistance system 103 further comprises a first resistance spring 161 a third cable 162, a ninth pulley 189 and a tenth pulley 190. The third resistance system 104 further comprises a second resistance spring 165, a fourth cable 166, an eleventh pulley 191 and a twelfth pulley 192. The third cable 162 is further defined with a twenty first end 221 and a twenty second end 222. The fourth cable 166 is further defined with a twenty third end 223 and a twenty fourth end 224.

The first resistance spring 161 is a coil extension spring, also referred to as a tension spring, which resists forces attempting to pull the first resistance spring 161 along the direction of the first resistance spring 161. The first resistance spring 161 is used to attach the first side brace 111 to the twenty first end 221 of the third cable 162. The ninth pulley 189 and the tenth pulley 190 are attached to the first side brace 111.

As shown most clearly in FIG. 2, the twenty second end 222 of the third cable 162 is threaded through the ninth pulley 189 and the tenth pulley 190 and is attached to a triangle 164. The triangle 164 is a single hand grip that is used to apply a force through the third cable 162 to the first resistance spring 161. In this mode of operation, the first resistance spring 161 is used to provide the resistance for curl and push type exercises. The twenty second end 222 of the third cable 162 is further adapted to receive a push pull bar 163. The push pull bar 163 is a commercially available shaft used in weight training to allow an exerciser to pull loads with two hands.

The second resistance spring 165 is a coil extension spring, also referred to as a tension spring, which resists forces attempting to pull the second resistance spring 165 along the direction of the second resistance spring 165. The second resistance spring 165 is used to attach the second side brace 112 to the twenty third end 223 of the fourth cable 166. The eleventh pulley 191 and the twelfth pulley 192 are attached to the second side brace 112.

As shown most clearly in FIG. 2, the twenty fourth end 224 of the fourth cable 166 is threaded through the eleventh pulley 191 and the twelfth pulley 192 and is attached to a triangle 164. The triangle 164 is a single hand grip that is used to apply a force through the fourth cable 166 to the second resistance spring 165. In this mode of operation, the second resistance spring 165 is used to provide the resistance for curl and push type exercises. The twenty fourth end 224 of the fourth cable 166 is further adapted to receive a push pull bar 163. The push pull bar 163 is a commercially available shaft used in weight training to allow an exerciser to pull loads with two hands.

The invention 100 is used as a normal weight training machine with the following modification: to perform resistance exercises on the first resistance system 102, the exerciser sits or stands on the stand plate 140 of the weight stand 130 to during these exercises.

In the first potential embodiment of this disclosure the braces, cross struts, and guards are made of commercially available steel tubing. The steel plate 120 is a described in this disclosure is a commercially available steel plate. All the described attachments between the braces, cross struts, guards, and plates are welded. All cables described in this disclosure are commercially available metal cables. The end of all cables described in this disclosure, are attached to eyebolts or carabiners. All runners, pulleys and wheels described in this disclosure are commercially available and are attached to the frame 101 using commercially available hardware. The weight bars, push pull bars, and triangles discussed in this disclosure are and commercially available and commonly used in weight training. The resistance springs discussed in this disclosure are commercially available and are attached to the frame 101 using commercially available hardware. The height extension 137 is formed from commercially available hardware. Methods to select the materials described in this disclosure are well known and documented in the mechanical arts. Methods to make the attachments as described in this disclosure are well known and documented in the mechanical arts.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Elastic: As used in this disclosure, an elastic is a material or object that deforms when a force is applied to it and that is able to return to its original shape after the force is removed. A material that exhibits these qualities is also referred to as an elastomeric material.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Tension Spring: As used in this disclosure, a tension spring, also commonly referred to as an extension spring, is a wire coil that resists forces attempting to pull the wire coil in the direction of the center axis of the wire coil. The tension spring will return to its original position when the pulling force is removed.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An exercise device comprising:

a frame and a first resistance system;

wherein the first resistance system is attached to the frame;

wherein the exercise device is adapted for use in physical training;

wherein the exercise device is a resistance based physical training device;

wherein the physical training creates a counterforce required for the resistance based physical training device;

wherein the frame comprises a platform, a first side brace, a second side brace, a top brace, a first cross strut, a second cross strut, a third cross strut, and a fourth cross strut;

wherein the platform, the first side brace, the second side brace, the top brace, the first cross strut, the second cross strut, the third cross strut, and the fourth cross strut are attached to each other;

wherein the first side brace is further defined with a first end and a second end;

wherein the second side brace is further defined with a third end and a fourth end;

wherein the top brace is further defined with a fifth end and a sixth end;

wherein the first cross strut is further defined with a beveled seventh end and a beveled eighth end;

wherein the second cross strut is further defined with a beveled ninth end and a beveled tenth end;

wherein the third cross strut is further defined with a beveled eleventh end and a beveled twelfth end;

wherein the fourth cross strut is further defined with a beveled thirteenth end and a beveled fourteenth end;

wherein the platform further comprises a steel plate, a first tip guard, and a second tip guard;

wherein the first tip guard is attached to the steel plate;

wherein the second tip guard is attached to the steel plate;

wherein the platform is a bottom structure of the exercise device;

wherein the platform rests directly on a supporting surface;

wherein the first tip guard is a metal tube;

wherein the second tip guard is a metal tube;

wherein the first tip guard attaches to the steel plate such that a major length of the first tip guard is parallel to the supporting surface;

wherein the second tip guard attaches to the steel plate such that a major length of the second tip guard is parallel to the supporting surface;

wherein the first tip guard is perpendicular to a line that connects the center of the first side brace to the center of the second side brace;

wherein the second tip guard is perpendicular to a line that connects the center of the first side brace to the center of the second side brace;

wherein the first end of the first side brace is attached to the steel plate and the first tip guard such that the first side brace projects perpendicularly away from the steel plate;

wherein the third end of the second side brace is attached to the steel plate and the second tip guard such that the second side brace projects perpendicularly away from the steel plate;

wherein the seventh end of the first cross strut is attached to the steel plate and the first tip guard;

wherein the eighth end of the first cross strut is attached to the first side brace;

wherein the ninth end of the second cross strut is attached to the steel plate and the first tip guard;

wherein the tenth end of the second cross strut is attached to the first side brace;

wherein the eleventh end of the third cross strut is attached to the steel plate and the second tip guard;

wherein the twelfth end of the third cross strut is attached to the second side brace;

wherein the thirteenth end of the fourth cross strut is attached to the steel plate and the second tip guard;

wherein the fourteenth end of the fourth cross strut is attached to the second side brace;

wherein the second end of the first side brace is attached to the fifth end of the top brace;

wherein the fourth end of the second side brace is attached to the sixth end of the top brace;

wherein the first resistance system comprises a weight stand, a first cable, a second cable, a first plurality of pulleys, a second plurality of pulleys, a first weight bar, a second weight bar and a height extension;

wherein the first cable is further defined with a seventeenth end and an eighteenth end;

wherein the second cable is further defined with a nineteenth end and a twentieth end;

wherein the weight stand is attached to the first weight bar using the first plurality of pulleys, the second plurality of pulleys, the first cable, and the second cable;

wherein the second weight bar and the height extension are added to the first weight bar;

wherein the weight stand further comprises a stand plate, a first runner, a second runner, a third runner, a fourth runner, a first track wheel, a second track wheel, a third track wheel, and a fourth track wheel;

wherein the stand plate is further defined with a fifteenth end and a sixteenth end;

wherein the stand plate is a metal tube;

wherein the first track wheel, the second track wheel, the third track wheel, and the fourth track wheel attach the stand plate to the first runner, the second runner, the third runner, and the fourth runner;

wherein the first runner is attached to the first side brace;

wherein the second runner is attached to the first side brace;

wherein the third runner is attached to the second side brace;

wherein the fourth runner is attached to the second side brace;

wherein the first runner is attached to the first side brace such that any track wheel running in the first runner will roll in a direction perpendicular to the steel plate;

wherein the second runner is attached to the first side brace such that any track wheel running in the second runner will roll in a direction perpendicular to the steel plate;

wherein the third runner is attached to the second side brace such that any track wheel running in the third runner will roll in a direction perpendicular to the steel plate;

wherein the fourth runner is attached to the second side brace such that any track wheel running in the fourth runner will roll in a direction perpendicular to the steel plate;

wherein the first track wheel and the second track wheel are attached to the fifteenth end of the stand plate;

wherein the third track wheel and the fourth track wheel are attached to the sixteenth end of the stand plate;

wherein the first track wheel is positioned such that the first track wheel is inserted into the first runner;

wherein the second track wheel is positioned such that the second track wheel is inserted in the second runner;

wherein the third track wheel is positioned such that the third track wheel is inserted into the third runner;

wherein the fourth track wheel is positioned such that the fourth track wheel is inserted in the fourth runner;

wherein the stand plate further comprises a first eyebolt, a second eyebolt, and an attachment;

wherein the first eyebolt is attached to the surface of the stand plate that is distal from the support surface;

wherein the second eyebolt is attached to the surface of the stand plate that is distal from the support surface;

wherein the attachment is attached to a stand plate;

wherein the first plurality of pulleys comprises a first pulley, a second pulley, a third pulley, and a fourth pulley;

wherein the first pulley, the second pulley, and the third pulley are mounted on the first side brace;

wherein the fourth pulley is mounted on the top brace;

wherein the second plurality of pulleys comprises a fifth pulley, a sixth pulley, a seventh pulley, and an eighth pulley;

wherein the fifth pulley, the sixth pulley and the seventh pulley are mounted on the second side brace;

wherein the eighth pulley is mounted on the top brace.

2. The exercise device according to claim 1 wherein the eighteenth end of the first cable is threaded through the first pulley, the second pulley, the third pulley, and the fourth pulley;

wherein the first cable is attached to the first weight bar;

wherein the twentieth end of the second cable is threaded through the fifth pulley, the sixth pulley, the seventh pulley, and the eighth pulley;

wherein the second cable is attached to the first weight bar.

3. The exercise device according to claim 2 wherein the exercise device further comprises a second resistance system;

wherein the third cable is further defined with a twenty first end and a twenty second end;

wherein the second resistance system is mounted to the first side brace.

4. The exercise device according to claim 3 wherein the second resistance system further comprises a first resistance spring a third cable, a ninth pulley and a tenth pulley;

wherein the first resistance spring is a first coil extension spring;

wherein the first resistance spring attaches the first side brace to the twenty first end of the third cable;

wherein the ninth pulley and the tenth pulley are mounted to the first side brace;

wherein the twenty second end of the third cable is threaded through the ninth pulley and the tenth pulley;

wherein the twenty second end of the third cable is adapted to receive a device selected from the group consisting of a first triangle or a push pull bar.

5. The exercise device according to claim 4 wherein the exercise device further comprises a second resistance system;

wherein the fourth cable is further defined with a twenty third end and a twenty fourth end;

wherein the third resistance system is mounted to the second side brace.

6. The exercise device according to claim 5 wherein the third resistance system further comprises a second resistance spring, a fourth cable, an eleventh pulley and a twelfth pulley;

wherein the second resistance spring is a coil extension spring;

wherein the second resistance spring attaches the second side brace to the twenty third end of the fourth cable;

wherein the eleventh pulley and the twelfth pulley are mounted to the second side brace;

wherein the twenty fourth end of the fourth cable is threaded through the eleventh pulley and the twelfth pulley;

wherein the twenty fourth end of the fourth cable is adapted to receive a device selected from the group consisting of a second triangle or the push pull bar.

* * * * *